US008044913B2

(12) United States Patent
Kuo et al.

(10) Patent No.: US 8,044,913 B2
(45) Date of Patent: Oct. 25, 2011

(54) DISPLAY DEVICE AND GATE DRIVER THEREOF

(75) Inventors: Mao-Hsiung Kuo, Tainan (TW); Chien-Pin Chen, Tainan (TW); Fa-Ming Chen, Tainan (TW)

(73) Assignee: Himax Technologies Limited (TW)

( * ) Notice: Subject to any disclaimer, the term of this patent is extended or adjusted under 35 U.S.C. 154(b) by 963 days.

(21) Appl. No.: 11/833,840

(22) Filed: Aug. 3, 2007

(65) Prior Publication Data

US 2008/0231582 A1 Sep. 25, 2008

(30) Foreign Application Priority Data

Mar. 23, 2007 (TW) ..... 96110246 A

(51) Int. Cl.
*G09G 3/36* (2006.01)

(52) U.S. Cl. ..... 345/98; 345/87; 345/204

(58) Field of Classification Search ..... 345/87–104, 345/211

See application file for complete search history.

(56) References Cited

U.S. PATENT DOCUMENTS

| | | | | |
|---|---|---|---|---|
| 2006/0176265 | A1* | 8/2006 | Kim et al. | 345/100 |
| 2006/0238477 | A1* | 10/2006 | Lew et al. | 345/94 |
| 2007/0024565 | A1* | 2/2007 | Choi | 345/98 |
| 2007/0229442 | A1* | 10/2007 | Yi | 345/100 |
| 2008/0007545 | A1* | 1/2008 | Chang et al. | 345/211 |
| 2008/0100558 | A1* | 5/2008 | Yu | 345/100 |

* cited by examiner

*Primary Examiner* — Alexander Eisen
*Assistant Examiner* — Viet Pham
(74) *Attorney, Agent, or Firm* — Baker & McKenzie LLP

(57) ABSTRACT

A gate driver for driving a display device is disclosed. The gate driver, which includes: a first input buffer configured to for receiving a reference voltage and outputting a first buffered voltage, a control circuit configured to for outputting a plurality of scan starting signals and compensating starting signals, a plurality of compensating output buffers, and a plurality of scan output buffers. Each of the plurality of compensating output buffers is configured to respectively receive one of the compensating starting signals and respectively output a compensating signal, wherein, each compensating output buffer receives the first buffered voltage as power. Each of the plurality of scanning output buffers is configured to respectively receive one of the scan starting signals and output a scan signal.

14 Claims, 4 Drawing Sheets

DISPLAY DEVICE AND GATE DRIVER THEREOF

RELATED APPLICATION

This application claims priority to Taiwan Patent Application No. 096110246 filed on Mar. 23, 2007 including the specification, claims, drawings and abstract. The disclosure of the above Taiwan Patent Application is incorporated herein by reference in its entirety.

BACKGROUND

1. Field of the Invention

This invention relates to a gate driver, and in particular, to a gate driver with an input buffer.

2. Background of the Invention

A liquid crystal display device includes a substrate and other related driving device. Further, there are a plurality of data lines and scan lines on the substrate, and a plurality of pixels that are defined by the intersection of the plurality of data lines and the plurality of scan lines. In order to display a frame, a source driver and a gate driver respectively provide a data signal and a scan signal to the corresponding data lines and the scan lines, as a result, each pixel will display a predetermined brightness and color. Besides, the gate driver can be coupled to the display device on the substrate.

FIG. 1A is a simplified diagram showing a plurality of gate drivers arranged on a substrate of a display device. In the FIG. 1A, the gate drivers 113, 115, and 117 are arranged on the substrate 110, and all are connected to reference voltages VSH and VSL via the wiring on the substrate 110. However, due to the resistance variation between the wiring, there must be a different voltage drop while a current flows through the wiring. The phenomenon is meant to be an "IR drop" on the wiring, resulting in different voltage values on different positions of the wiring. Consequently, the gate driver 113 receives input voltages VSH1 and VSL1, the gate driver 115 receives input voltages VSH2 and VSL2, and the gate driver 117 receives input voltages VSH3 and VSL3, where the values of each input voltage VSH1, VSH2 and VSH3 are different from each other. Additionally, the values of each input voltage VSL1, VSL2 and VSL3 are also different from each other as well. As described above, due to voltage drop variations caused by the current flowing through the wiring, the input voltages of the gate drivers 113, 115 and 117 are not the same, thus, the voltage output from the gate drivers 113, 115 and 117 differs from their predetermined voltage values. Therefore, it may be advantageous to adopt other configurations for arranging the plurality of gate drivers on the substrate.

Referring to FIG. 1B, showing a simplified diagram of a plurality of gate drivers on a display device, gate drivers 123, 125 and 127 are configured on the substrate 120 and connected by the wiring on substrate 120. The gate driver 123 is coupled to the reference voltage VSH and VSL and receives input voltages VSH4 and VSL4. The gate driver 125 is connected to gate driver 123 and receives input voltages VSH5 and VSL5. The gate driver 127 is also connected to the gate driver 125 and receives input voltages VSH6 and VSL6.

Similarly, due to the voltage drop caused by the current flowing through the wiring, the input voltages of the gate driver 123, 125 and 127 are not the same, thus, voltage output from the gate drivers 123, 125 and 127 differs from their predetermined voltage values.

SUMMARY

Systems and apparatuses for driving a display device are disclosed.

In one aspect, a gate driver for driving a display device is disclosed. The gate driver includes: a first input buffer configured to receive a reference voltage and output a first buffered voltage, a control circuit configured to output a plurality of scan starting signals and compensating starting signals, a plurality of compensating output buffers, and a plurality of scan output buffers. Each of the plurality of compensating output buffers is configured to respectively receive one of the compensating starting signals and respectively output a compensating signal, wherein, each compensating output buffer receives the first buffered voltage as power. Each of the plurality of scanning output buffers is configured to respectively receive one of the scan starting signals and output a scan signal.

In another aspect, a display device is disclosed. The display device includes: a substrate, a plurality of scan lines formed along the first direction, a plurality of data lines formed along the second direction, a plurality of pixels formed on the array areas defined by the plurality of scan lines and data lines, a plurality of compensating lines formed on the substrate and substantially parallel to the plurality of scan lines, a source driver connected to the data lines, and a gate driver. Each pixel has a first sub-pixel circuit, which includes a first transistor and a first storage capacitor. The first end of the first storage capacitor is connected with a corresponding data line via the first transistor and the second end of the first storage capacitor is connected to a corresponding compensating line. The gate driver includes: a buffered voltage output module which is connected to a reference source and outputs a buffered voltage, a scan signal output module connected to the scan lines, a compensating signal output module powered by the buffered voltage and connected to the compensating lines; and a control module that is connected to the scan signal output module and the compensating signal output module.

BRIEF DESCRIPTION OF THE DRAWINGS

For a more complete understanding of the principles disclosed herein, and the advantages thereof, reference is now made to the following descriptions taken in conjunction with the accompanying drawings, in which.

DETAILED DESCRIPTION

Systems and apparatuses for driving a display device are disclosed. It will be clear, however, that the present invention may be practiced without some or all of these specific details.

In other instances, well known process operations have not been described in detail in order not to unnecessarily obscure the present invention.

As discussed above, the plurality of gate drivers on a conventional display device typically receive different input voltages. With the implementation of a buffered voltage output module to buffer the reference voltages, the problems caused by the differences between the input voltages of each of the plurality of gate drivers can be solved, correspondingly, the stability of output voltages of the gate driver may also be improved.

Further, a display device which separately supplies a plurality of compensating signals to the corresponding capacitors in the sub-pixel circuits may enhance the contrast between the sub-pixels, correspondingly, resulting in the display of a high quality image with improved sharpness and vividness.

Figure 1A:
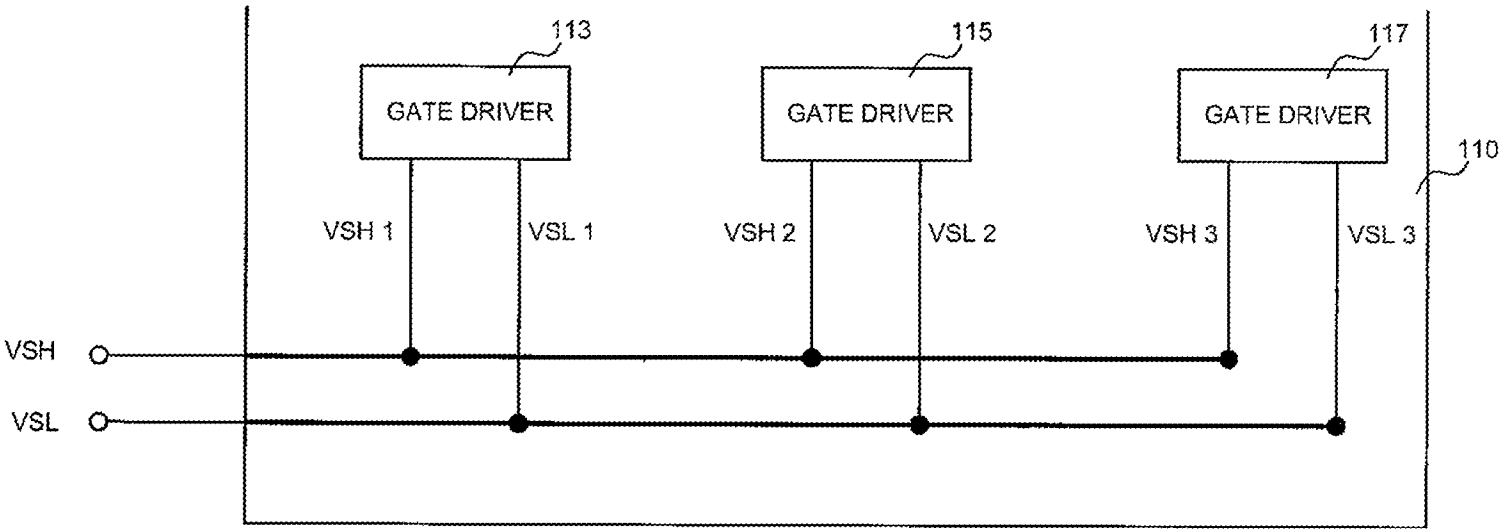
FIG. 1A is a simplified diagram of a plurality of gate drivers on a substrate of a display device.
Figure 1B:
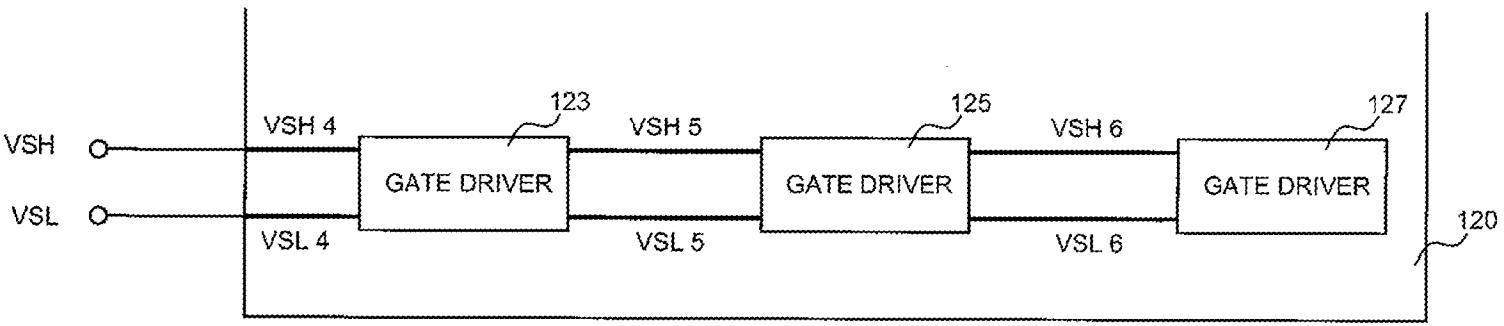
FIG. 1B is another simplified diagram of a plurality of gate drivers on a substrate of a display device.
Figure 2:
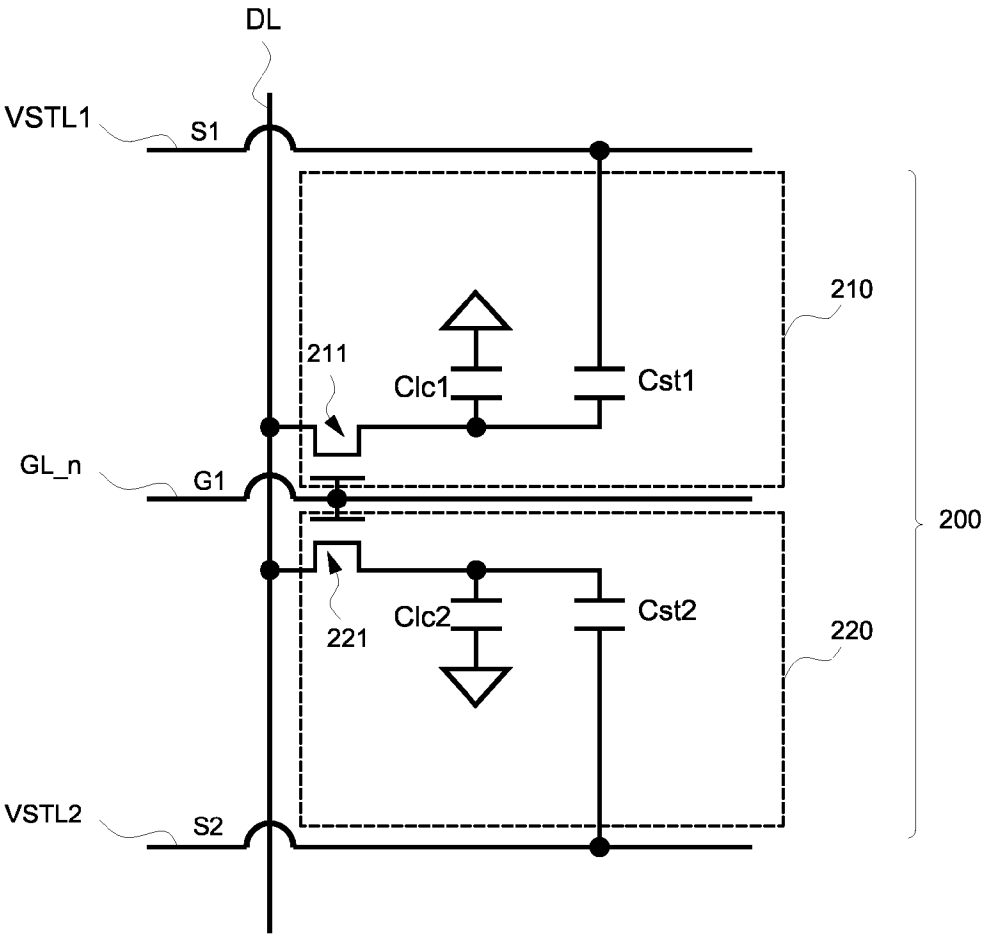
FIG. 2 is a circuit diagram showing a pixel of a display device, in accordance with certain embodiments.

FIG. 2 is a circuit diagram showing a pixel of a display device, in accordance with certain embodiments. A liquid crystal display device usually comprises a substrate made of transparent material, such as glass, a plurality of scan lines, a plurality of data lines, a plurality of compensating lines, a plurality of pixels, a source driver, and a gate driver on the substrate. The configuration of said components is approximately described below. The plurality of data lines intercross with the plurality of scan lines, the compensating lines are substantially parallel to the scan lines, and the plurality of pixels are formed in the array areas defined by the data lines and the scan lines. The source driver can be connected to the data lines, and the gate driver can be connected to the scan lines and the compensating lines. The configuration and function of the pixels will be described below in more detail.

Continuing with FIG. 2, a pixel 200 is depicted as including sub-pixel circuits 210, 220, wherein sub-pixel 210 is comprised of a select transistor 211, a liquid crystal capacitor Clc1 and a storage capacitor Cst1. Also, sub-pixel 220 is comprised of a select transistor 221, a liquid crystal capacitor Clc2 and a storage capacitor Cst2. Pixel 200 is coupled to a data line DL, the scan line GL_n and a pair of compensating lines VSTL1, VSTL2, where the data line DL and the scan line GL_n cross each other in different directions, and the above compensating lines VSTL1, VSTL2 can be configured to be parallel with scan line GL_n.

For a more detailed configuration of the sub-pixel circuit 210, one end of the storage capacitor Cst1 is connected to the corresponding data line DL coupled to the source driver via the select transistor 211, and the other end of storage capacitor Cst1 is connected to the corresponding compensating line VSTL1. Further, the select transistor 211 can be turned on or off according to a scan signal on the scan line, so as to charge or discharge the liquid crystal capacitor Clc1 and the storage capacitor Cst1 . Also, one end of the storage capacitor Cst2 is connected to the corresponding data line DL via the select transistor 221, and the other end of the storage capacitor is connected to the compensating line VSTL2.

As for the operation of the pixel 200, first the select transistors 211, 221 would be turned on or off according to the scan signal on the scan line GL_n. When the select transistors 211, 221 are turned on, the liquid crystal capacitors Clc1, Clc2 receive voltage of the data signal from the data line DL, and thus the potential difference between liquid crystal molecules positioned above the capacitors Clc1, Clc2 can be modulated. Consequently, in this embodiment, second ends of capacitors Cst1, Cst2 respectively receive the compensating signals S1, S2 of the compensating lines VSTL1, VSTL2, such that the voltage values on the storage capacitors Cst1, Cst2 would be compensated.

Figure 3B:
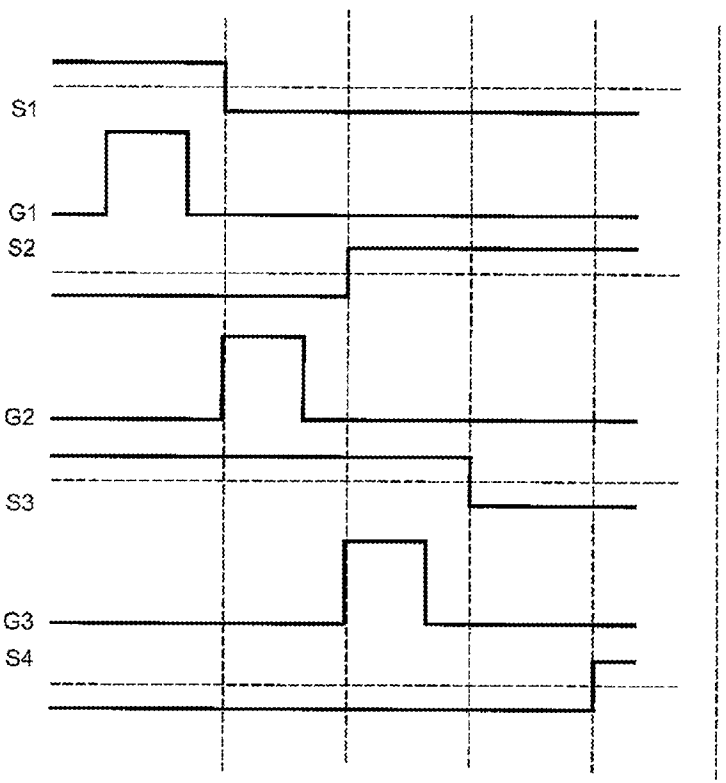
FIG. 3B is another timing diagram showing another example of scan signals and compensating signals of a gate driver in a second frame, in accordance with certain embodiments.
Figure 3A:
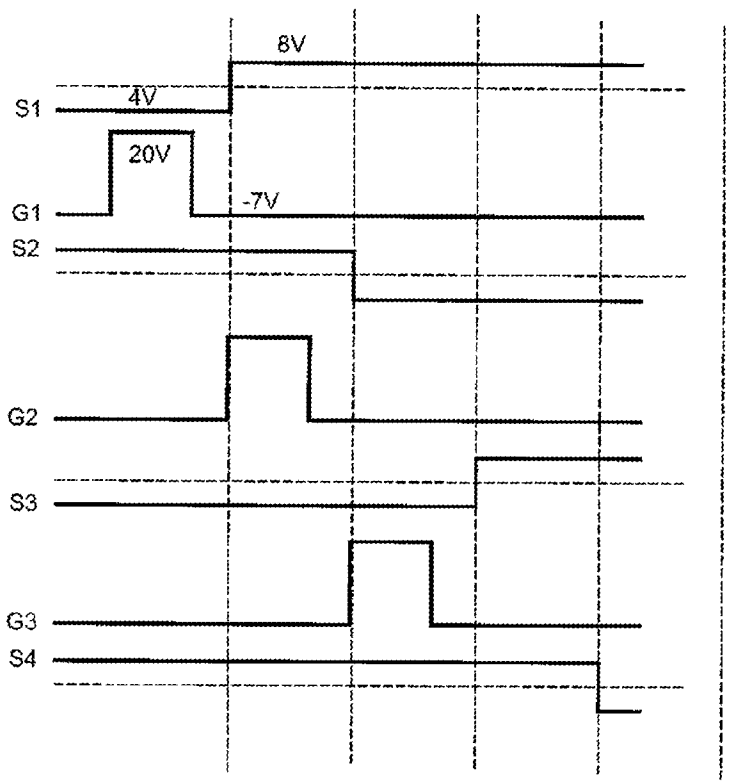
FIG. 3A is a timing diagram showing an example of scan signals and compensating signals of a gate driver in a first frame, in accordance with certain embodiments.

Referring to FIG. 3A and FIG. 3B, in the first frame, the scan signals G1~G3 and the compensating signals are respectively enabled, in accordance with certain embodiments. As depicted herein, the levels of the scan signal G1~G3 are 20V and −7V, respectively, and the levels of the compensating signal S1~S4 are 8V and 4V, respectively. Later, in the second frame, compared with the signals of the first frame, the phases of the compensating signals are reversed. With reference to FIG. 2, in the sub-pixel circuits 210 and 220, the select transistors 211, 221 are turned on to receive the scan signal G1 on the scan line; and the storage capacitors (i.e., Cst1 and Cst2) each respectively receive the compensating signals (i.e., S1 and S2) on the compensating lines (i.e., VSTL1 and VSTL2) to modulate the brightness of the corresponding sub-pixels. In this way, the contrast, sharpness and vividness of the image can be raised. It should be noted, however, that the phases and levels of the scan signals G1~G3 and the compensating signal S1~S4 are provided here for illustrative purposes only, in practice the voltage of the scan and compensating signals can take on any value as long as the voltage does not exceed the rated capacities of the underlying hardware component architecture of the pixel 200. The gate driver for generating the scan signals and compensating signals is further described as follows.

Figure 4:
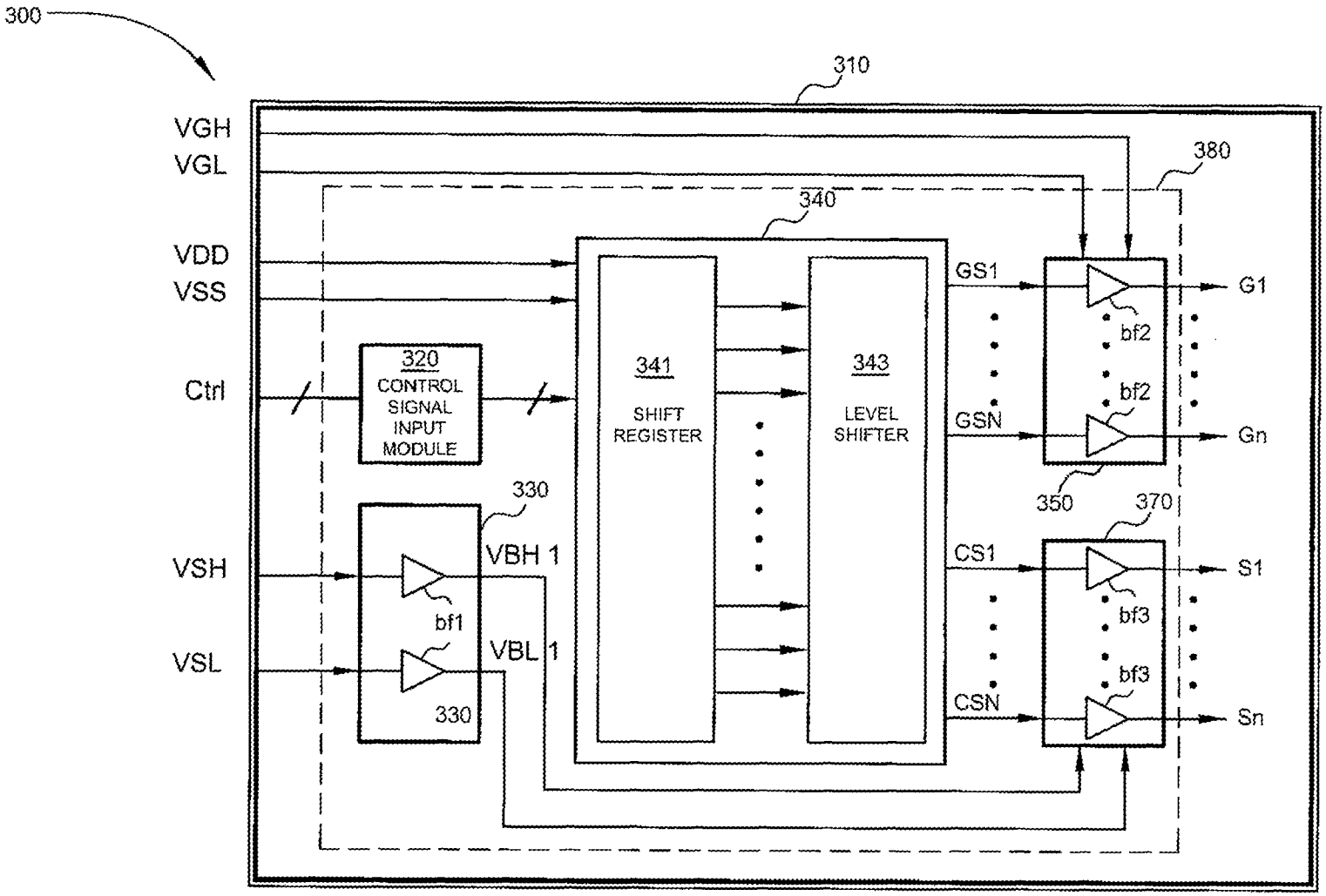
FIG. 4 is a circuit diagram showing a display device, in accordance with certain embodiments.

Referring to FIG. 4, a display device 300 including a substrate 310 and a gate driver 380 is shown in accordance with certain embodiments. The gate driver 380 has a control signal input module 320, a buffered voltage output signal module 330, a control module 340, a scan signal output module 350, and a compensating signal output module 370. The buffered voltage output module 330 can be comprised of two operational amplifiers as input buffers bf1 for respectively receiving the reference voltages (i.e., VSH and VSL) on the wiring of the substrate 310 and respectively outputting the buffered voltages (i.e., VBH1 and VBL1) to the compensating signal outputting module 370. The operational amplifier of the buffered voltage output module 330 can be used as a unity-gain amplifier. On the other hand, a control module 340 includes a shift register 341 and a level shifter 343, and the control module 340 receives reference voltages (i.e., VDD and VSS) as power, and receives a control signal Ctr1 from the control signal input module 320 to respectively output the scan starting signals GS1~GSN (where N is an integer) and the compensating starting signals CS1~CSN to the scan signal output module 350 and compensating signal output module 370.

As described herein FIG. 4, the scan signal output module 350 receives the reference voltages (i.e., VGH and VGL) as power, and receives the scan starting signals GS1~GSN from the control module 340 and outputs the scan signals G1~Gn to the corresponding scan lines. Also, the compensating signal output module 370 receives the buffered voltages (i.e, VBH1 and VBL1) as power, and receives the compensating starting signals CS1~CSN from the control module 340 and outputs the compensating signals S1~Sn to the corresponding compensating lines. Further, the scan signal output module 350 and the compensating signal output module 370 include scan output buffers bf2 and compensating output buffers bf3, respectively. Said compensating signals S1~Sn could compensate the voltage of the storage capacitor in the corresponding sub-pixel circuit, thus the brightness and contrast of the sub-pixels can be upgraded. It is because the compensating output module 370 receives the buffered voltages (i.e., VBH1 and VBL1) as power, that the problem caused by the IR drop does not result in the distortion of the compensating signals, and also stabilizes the compensating effect on the brightness and contrast levels of the sub-pixel.

It should be noted that the gate driver 380 of the above embodiment is integrated on a chip, which means the control signal input module, buffered voltage output module, control module, scan signal output module and compensating signal output module are all configured on the chip. Compared with the conventional gate driver, which is incapable of solving the problem of the IR drop, the gate driver of this embodiment can effectively improve the IR drop with a simplified process and lower cost by utilizing a buffered voltage output module to buffer reference voltages.

Although certain embodiments of the invention have been described in detail herein, it should be understood, by those of ordinary skill, that the invention may be embodied in many other specific forms without departing from the spirit or scope of the invention. Therefore, the present examples and embodiments are to be considered as illustrative and not restrictive, and the invention is not to be limited to the details provided therein, but may be modified and practiced within the scope of the appended claims.

What is claimed:

1. A gate driver suitable for use in a display device, wherein the display device includes a substrate adapted to have the gate driver mounted thereon, the substrate including a scan line, a compensating line, a data line, at least a first wiring line adapted to provide a first reference voltage, and a pixel including a transistor and a storage capacitor, wherein a first end of the storage capacitor is connected to the data line via the transistor, and a second end of the storage capacitor is connected to the compensating line, the gate driver comprising:

a first input buffer including a first operational amplifier, wherein the first operational amplifier has a first input connected to the first wiring line of the substrate to convert the first reference voltage into a first buffered voltage;

a control circuit adapted to output at least one scan starting signal and compensating starting signal;

a compensating output buffer adapted to receive the compensating starting signal and the first buffered voltage as a power voltage, and output a compensating signal on the compensating line of the substrate; and a scanning output buffer adapted to receive the scan starting signal and output a scan signal on the scan line of the substrate.

2. The gate driver of claim 1, wherein the first operational amplifier is a unity-gain amplifier.

3. The gate driver of claim 1, wherein the substrate includes a second wiring line adapted to provide a second reference voltage, and the gate driver further comprising a second input buffer comprised of a second operational amplifier that has a second input connected to the second wiring line of the substrate to convert the second reference voltage into a second buffered voltage used as a second power voltage by the compensating output buffer.

4. The gate driver of claim 3, wherein any of the first and second operational amplifiers is a unity-gain amplifier.

5. The gate driver of claim 1, wherein the control circuit comprises a shift register and a level shifter.

6. The gate driver of claim 1, wherein the scanning output buffer is adapted to receive third and fourth reference voltages as power voltages.

7. The gate driver of claim 6, wherein the control circuit receives fifth and sixth reference voltages as power voltages.

8. The gate driver of claim 1, wherein the gate driver, including the first input buffer, the control circuit, the compensating output buffer and the scanning output buffer, is integrated into a chip to be mounted on the substrate.

9. A display device comprising:

a substrate including:

a scan line formed in a first direction, and a compensating line substantially parallel to the scan line;

a data line formed in a second direction;

at least two wiring lines adapted to provide a first and a second reference voltage; and a pixel including a transistor and a storage capacitor, wherein a first end of the storage capacitor is connected to the data line via the transistor, and a second end of the storage capacitor is connected to the compensating line;

a source driver assembled on the substrate and connected with the data line; and a gate driver assembled on the substrate, wherein the gate driver includes:

a buffered voltage output module including two operational amplifiers having inputs respectively connected to the wiring lines of the substrate to receive the first and second reference voltages, wherein the operational amplifiers are configured to respectively convert the first and second reference voltages respectively into first and second buffered voltages;

a compensating signal output module connected to the compensating line, wherein the compensating signal output module is adapted to receive the first and second buffered voltages as power voltages, and output at least one compensating signal on the compensating line;

a scan signal output module connected to the scan line; and a control module connected to the scan signal output module and the compensating signal output module.

10. The display device of claim 9, wherein the control module comprises a shift register and a level shifter.

11. The display device of claim 9, wherein the control module is configured to output a scan starting signal and a compensating starting signal to enable the scan signal output module and the compensating signal output module.

12. The display device of claim 11, wherein the scan signal output module outputs a scan signal in accordance with the scan starting signal, and the compensating signal output module outputs the compensating signal in accordance with the compensating starting signal, the scan signal and the compensating signal being applied to drive the pixel.

13. The display device of claim 9, wherein the operational amplifiers include unity-gain amplifiers.

14. The display device of claim 9, wherein the pixel further includes a second transistor and a second storage capacitor, a first end of the second storage capacitor being connected to a second data line on the substrate via the second transistor, and a second end of the second storage capacitor being connected to a second compensating line on the substrate.

* * * * *